United States Patent [19]

Belsanti

[11] 4,398,507

[45] Aug. 16, 1983

[54] CONNECTING ROD SPRAY ORIFICE FOR COOLING OF A PISTON

[75] Inventor: James F. Belsanti, Blue Island, Ill.

[73] Assignee: Allis-Chalmers Corporation, Milwaukee, Wis.

[21] Appl. No.: 314,132

[22] Filed: Oct. 23, 1981

[51] Int. Cl.[3] ..... F01P 3/06

[52] U.S. Cl. ..... 123/41.38

[58] Field of Search ..... 123/41.35, 41.37, 41.38; 92/110

[56] References Cited

U.S. PATENT DOCUMENTS

| | | | |
|---|---|---|---|
| 3,056,638 | 10/1962 | Hovde | 123/41.38 |
| 3,785,459 | 1/1974 | Patchen | 184/6.5 |
| 3,842,938 | 10/1974 | Barnes-Moss | 184/6.5 |
| 4,142,484 | 3/1979 | Buhl | 123/41.35 |

*Primary Examiner*—William A. Cuchlinski, Jr.

*Attorney, Agent, or Firm*—Arthur L. Nelson

[57] ABSTRACT

Connecting rod orifices spray oil on the underside of a piston of an internal combustion engine. The orifices are constructed to produce a wide spray evenly distributed across the underside of the piston beneath the combustion chamber in the internal combustion engine.

13 Claims, 5 Drawing Figures

CONNECTING ROD SPRAY ORIFICE FOR COOLING OF A PISTON

This invention relates to a piston cooling system for an internal combustion engine and more particularly to a connecting rod spray orifice for spraying pressurized oil on the underside of the piston beneath the combustion chamber.

Most larger internal combustion engines are normally cooled by a liquid coolant. For a naturally aspirated engine a liquid coolant is usually adequate to keep the engine operating under normal conditions. Increasing the output of a naturally aspirated engine through supercharging, increases the total energy supplied in the fuel and increases the power output from the engine and accordingly, greater cooling is necessary to maintain normal operating conditions. Pressurized fluid cooling systems are illustrated in the Barnes-Moss patent, U.S. No. 3,842,938, and the Patchen patent, U.S. No. 3,785,459. These patents disclose pressurized cooling systems using the lubricating fluid to spray on the underside of the piston and passages formed in the crankshaft and connecting rod. These systems operate in a manner in which the rotation of the crankshaft causes a valve action to open the passages when the inertia forces on the fluid plus the pressure in the hydraulic system cause oil to spray the underside of the piston for cooling of the piston. The applicant's device is similar to these patents and uses a valve arrangement to spray lubricating oil on the underside of the piston when the inertia forces and the pressure in the pressurized system are additive. The applicant has provided for an orifice which will evenly spray the pressurized oil across the bottom surface of the piston immediately beneath the combustion chamber. The applicant provides for a broom spray as sweeps across the bottom surface of the piston and provides uniform cooling to maintain good operating conditions for the engine.

It is an object of this invention to provide a pressurized fluid cooling system for cooling a piston of an internal combustion engine.

It is another object of this invention to provide a pressurized fluid cooling system with passages in the crankshaft and connecting rod to transmit the fluid to the wrist pin bearing which forms an orifice for uniformly spraying the underside of the piston to cool the engine.

It is a further object of this invention to provide a pressurized hydraulic fluid cooling system by transmitting the hydraulic fluid through passages in the crankshaft and connecting rod to an orifice in the wrist pin bearing providing a broom spray to uniformly cool the underside of the piston immediately beneath the combustion chamber for cooling of the internal combustion engine.

The objects of this invention are accomplished in a hydraulic fluid cooling system in which the lubricating oil is pumped through a passage in the crankshaft and connecting rod to an orifice in the wrist pin bearing. The orifice is relatively short compared to its cross-sectional dimension. The orifice may be rectangular, circular, or other configuration and in the event that it is a circular orifice, the length of the orifice over the diameter is approximately unity or less to provide a broom spray for the spray across the underside of the piston when the engine is in operation. This provides a uniform cooling of the piston and a cooling of the surface immediately under the combustion chamber in the engine. It assures uniform cooling of the piston for improved operating conditions.

Referring to the drawings, the perferred embodiment of this invention is illustrated.

Figure 1:
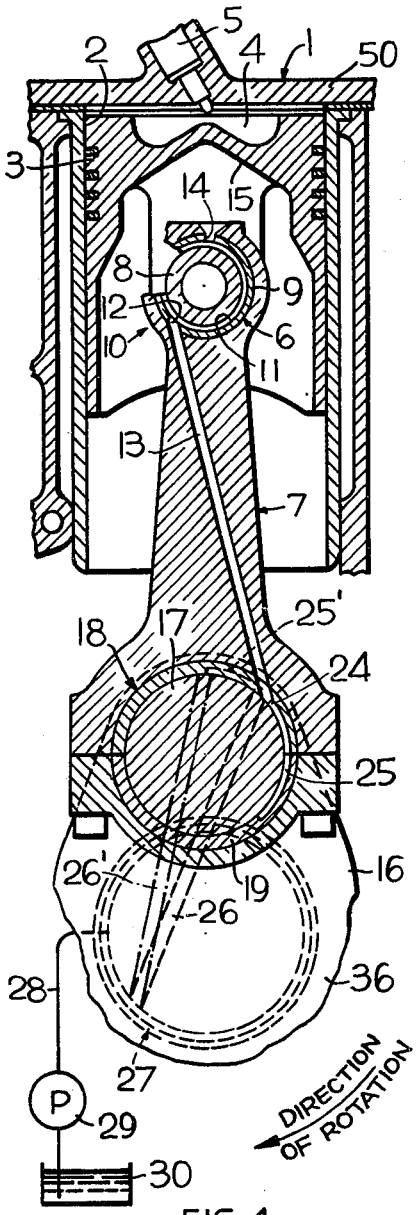
FIG. 1 illustrates a cross-section view of the internal combustion engine and the hydraulic fluid lubricating and cooling system.

Referring to the drawings the engine 1 is shown in cross section. The cylinder 2 receives the piston 3 which forms a combustion chamber 4 with the head 50. Fuel injector 5 injects fuel into the combustion chamber 4 during engine operation. The wrist pin bearing 6 connects the piston 3 to the connecting rod 7. The wrist pin bearing includes a wrist pin 8 and a bushing 9 carried in the wrist pin end 10 of the connecting rod. The inner periphery of the bushing 9 is formed with an annular groove 11 which receives pressurized fluid from the port 12 in the bushing and the diagonal passage 13 in the connecting rod. An orifice 14 is formed in the upper end of the rod and bushing 9 which is in communication with the annular groove 10. The orifice sprays cooling fluid on the underside 15 of the piston immediately under the combustion chamber 4.

The crankshaft 16 includes a crank pin 17. The crank pin bearing 18 includes the bushing 19 received within the crank pin end of the connecting rod 7. The passage 13 is in communication with the port 24 which is also in communication with the arcuate recess 25. Normally the passage 26 receives fluid from the main bearing 27 which is in communication with conduit 28 and lubrication pump 29. The pump 29 receives fluid from the reservoir 30. As the crankshaft rotates, the passage 26 is in communication with the arcuate recess 25 for about 120 degrees. The arcuate recess 25 and the passage 26 may be increased if desired so there is 180 degrees of communication between the passage and the recess as shown by recess 25' and passage 26'. Fluid is allowed to pass through the connecting rod to the orifice 14 to spray on the underside of the piston. During this phase of operation, inertia forces on the hydraulic fluid assist the pressure in the pressurized system to spray the underside of the piston. During the remainder of the cycle, the inertia forces are such that the pressure is not sufficient to provide adequate cooling as the fluid flow is reduced substantially since the inertia forces on the fluid column in the passage 13 essentially cancel the pressure of the pressurized fluid in the system. The reason for this being the connecting rod is moving upwardly tending to force fluid downwardly in the connecting rod.

Figure 2:
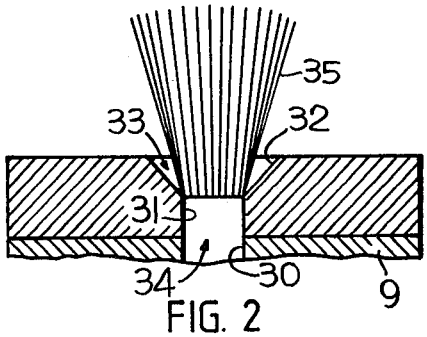
FIG. 2 illustrates an enlarged cross-section view of the orifice on the wrist pin bearing.
Figure 4:
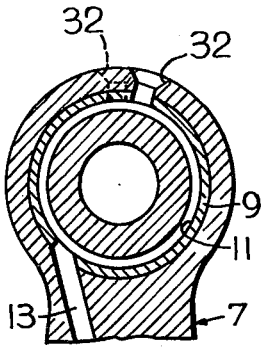
FIG. 4 is a side view of a modification showing more than one orifice in the bearing.
Figure 3:
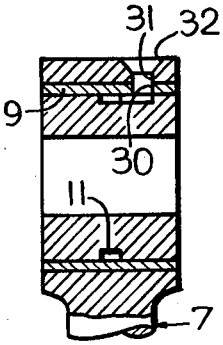
FIG. 3 is a cross-section view of the wrist pin bearing and the orifice.

Referring to FIGS. 2, 3, and 4 the wrist pin bearing and orifice is shown. The bushing 9 receives a wrist pin and is formed with an opening 30 which is a continuation of the opening 31 in the connecting rod to form an orifice. A countersink 32 is formed in the connecting rod bearing to effectively shorten the orifice. As shown in FIG. 2, the flared portion 33 produces an enlarged opening so that the orifice 34 is effectively shortened and fluid contact forms a flared spray on the underside of the piston. The spray 35 is shown in FIG. 2 as it spreads out to sweep across the underside of the piston.

The operation of the device will be described in the following paragraphs.

Figure 5:
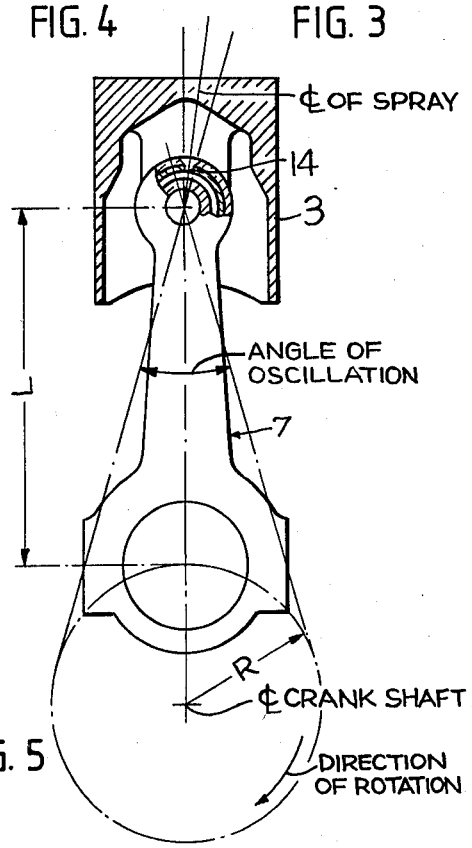
FIG. 5 is a view showing the preferred position of the orifice or orifices.

The pump 29 is driven by the engine and pressurizes fluid in the conduit 28. The conduit 28 is connected to the main bearing 36 and supplies pressurized fluid to the passage 26 and the crank pin bearing 18. Fluid flows from the crank pin bearing 18 through passage 13 when the piston is moving downward and the inertia forces on the fluid and passage 13 tend to force the fluid upwardly into the wrist pin 10 and out the orifice 14. Due to the valving arrangement in the crank pin bearing 18, pressurized fluid flows through the crankshaft and out the orifice 14 during this portion of the cycle. The inertia forces on the fluid in the passage 13 essentially nullify the force of the pressurized fluid when the piston is moving upwardly. Accordingly, the valving arrangement is provided in the crank pin bearing to prevent flow during this portion of the cycle. As the piston and connecting rod move downwardly, the angularity of the connecting rod and the crankarm varies. Geometry of the connecting rod and crankarm are generally shown in FIG. 5. In order to provide a uniform spray across the underside of the piston, the orifice 14 is angularly offset as indicated in FIG. 5. This angularity is approximately 7-½° but depends on the connecting rod length and the radius of the crankarm. As the piston moves downward and the connecting rod angles with the crankarm the spray sweeps across the underside of the piston for cooling across the surface immediately beneath the combustion chamber 4. The length of the sweep can also be controlled by the length of the arcuate passage 25 of the wrist pin bearing. The length of the arcuate passage is designed to provide optimum cooling for the piston.

The orifice is constructed so that the length is relatively short with relation to the diameter of the orifice. This construction will cause the fluid spraying from the orifice to spread outwardly causing a "broom" spray as it sweeps across the underside of the piston. The relationship of the length over the diameter of the orifice should be unity or less in order to produce this type of a spray. To facilitate construction of an orifice, the orifice opening is initially drilled and then countersunk. The countersink determines the length of the orifice relationship of the length over the diameter.

The embodiments of the invention in which an exclusive property or privilege is claimed are defined as follows:

1. A hydraulic fluid cooling system for an internal combustion engine comprising, a source of pressurized fluid, a crankshaft having passage means connected to said source of pressurized fluid, a connecting rod having passage means connected to said passage means in said crankshaft, a piston, a wrist pin bearing connecting said piston to said connecting rod, an orifice means on said wrist pin bearing connected to said passage means in said connecting rod, said orifice means on said wrist pin bearing including a shorter axial length dimension than the cross-sectional dimension across the orifice thereby providing a widely diverging spray on the underside of said piston.

2. A hydraulic fluid cooling system for an internal combustion engine as set forth in claim 1 wherein said orifice defines a circular cross-section, the length of said orifice over the diameter of said orifice is less than unity.

3. A hydraulic fluid cooling system for an internal combustion engine as set forth in claim 1 wherein the length of the orifice is slightly less than the cross-sectional width of said orifice.

4. A hydraulic fluid cooling system for an internal combustion engine as set forth in claim 1 including, means defining a longitudinal axis of said connecting rod, means defining central axis of said orifice means angularly displaced relative to the longitudinal axis of said connecting rod for uniformly sweeping across all of the undersurface of said piston as said piston moves downwardly and the cooling fluid is discharged from said orifice.

5. A hydraulic fluid cooling system for an internal combustion engine as set forth in claim 1 wherein said orifice is angularly displaced from the longitudinal center of said connecting rod.

6. A hydraulic fluid cooling system for an internal combustion engine as set forth in claim 1 including, a crank pin bearing connecting said crankshaft to said connecting rod, valve means in the crank pin bearing for spraying cooling fluid on the underside of said piston on the downward stroke of said piston.

7. A hydraulic fluid cooling system for an internal combustion engine as set forth in claim 1 wherein said connecting rod defines a longitudinal center line, said piston defining a center line, said orifice means define a central axis, means angularly offsetting the central axis of said orifice relative to the longitudinal center of said connecting rod for sweeping to both sides of said piston center line during the downward stroke of said piston.

8. A hydraulic fluid cooling system for an internal combustion engine as set forth in claim 1 wherein said piston defines a combustion chamber immediately above said orifice means on said wrist pin bearing, said orifice means includes a plurality of orifices.

9. A hydraulic fluid cooling system for an internal combustion engine as set forth in claim 1 wherein said connecting rod defines a longitudinal axis, said orifice means in said wrist pin bearing including a plurality of orifices defining axes angularly offsetting relative to said longitudinal axis of said connecting rod for providing a spray across a wide area of the undersurface of said piston.

10. A hydraulic fluid cooling system for an internal combustion engine as set forth in claim 1 wherein said orifice means defines a drilled cylindrical opening, a countersunk portion determining the effective length of the orifice and for providing a wide spray.

11. A hydraulic fluid cooling system for an internal combustion engine as set forth in claim 1 wherein the orifice means defines a cylindrical opening, a recessed portion on the radially outer end of said cylindrical opening for providing a ratio of length over diameter of less than unity.

12. A hydraulic fluid cooling system for an internal combustion engine as set forth in claim 1 wherein said orifice means defines a cylindrical opening, a countersink end portion determining the effective length of said orifice means causing the length over diameter ratio of said orifice to be less than unity.

13. A hydraulic fluid cooling system for an internal combustion engine as set forth in claim 1 wherein said orifice means includes a drilled opening on the radially inner end, a countersunk outer end on said orifice means determining the effective length of said orifice.

* * * * *